US009988848B2

(12) United States Patent
Jordan et al.

(10) Patent No.: US 9,988,848 B2
(45) **Date of Patent: *Jun. 5, 2018**

(54) METHOD AND APPARATUS FOR DRILLING MULTIPLE SUBSEA WELLS FROM AN OFFSHORE PLATFORM AT A SINGLE SITE

(71) Applicant: SINGLE BUOY MOORINGS, INC., Marly (CH)

(72) Inventors: Travis Randall Jordan, Houston, TX (US); Robert M. Kipp, Houston, TX (US)

(73) Assignee: Single Buoy Moorings, Inc., Marly (CH)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/600,107

(22) Filed: May 19, 2017

(65) Prior Publication Data

US 2017/0298694 A1 Oct. 19, 2017

Related U.S. Application Data

(63) Continuation of application No. 15/260,900, filed on Sep. 9, 2016, now Pat. No. 9,677,368, which is a (Continued)

(51) Int. Cl.
*E21B 7/12* (2006.01)
*E21B 19/00* (2006.01)

(Continued)

(52) U.S. Cl.
CPC ..... *E21B 7/12* (2013.01); *B63B 35/4413* (2013.01); *E21B 7/132* (2013.01); *E21B 15/003* (2013.01);

(Continued)

(58) Field of Classification Search
CPC ..... E21B 7/12; E21B 15/003; E21B 19/004; E21B 19/006; E21B 33/038; E21B 41/10
See application file for complete search history.

(56) References Cited

U.S. PATENT DOCUMENTS 3,474,629 A * 10/1969 Woodson ..... E21B 15/003 175/7
3,502,143 A 3/1970 Petersen (Continued)

FOREIGN PATENT DOCUMENTS

WO WO-9932352 A1 * 7/1999 ..... B63B 35/4413
WO 2010055172 A2 5/2010

OTHER PUBLICATIONS

Search Report received in corresponding Singapore application No. 10201602165R, dated Feb. 28, 2017.

*Primary Examiner* — Matthew R Buck
(74) *Attorney, Agent, or Firm* — Blank Rome LLP

(57) ABSTRACT

A floating, offshore drilling and/or production platform is equipped with a rail-mounted transport system that can be positioned at a plurality of selected positions over the well bay of the vessel. The transport system can move a drilling riser with a drilling riser tensioner system and a blowout preventer from one drilling location to another without removing them from the well bay of the vessel. Using the transport system, the drilling riser is lifted just clear of a first well head and positioned over an adjacent, second well head using guidelines. The transport system may then move the upper end of the drilling riser (together with its attached tensioner and BOP) to a second drilling location. A dummy wellhead may be provided on the seafloor in order to secure the lower end of the drilling riser without removing it from the sea while production risers are being installed.

20 Claims, 16 Drawing Sheets

Related U.S. Application Data continuation of application No. 14/919,486, filed on Oct. 21, 2015, now Pat. No. 9,458,671, which is a continuation of application No. 13/646,277, filed on Oct. 5, 2012, now Pat. No. 9,238,943.

(60) Provisional application No. 61/543,663, filed on Oct. 5, 2011, provisional application No. 61/606,031, filed on Mar. 2, 2012, provisional application No. 61/610,805, filed on Mar. 14, 2012.

(51) Int. Cl.

| | |
|---|---|
| ***E21B 7/132*** | (2006.01) |
| ***B63B 35/44*** | (2006.01) |
| ***E21B 15/00*** | (2006.01) |
| *E21B 41/10* | (2006.01) |
| *E21B 33/038* | (2006.01) |

(52) U.S. Cl.

CPC ..... *E21B 19/006* (2013.01); *E21B 33/038* (2013.01); *E21B 41/10* (2013.01)

(56) References Cited

U.S. PATENT DOCUMENTS 4,007,782 A * 2/1977 Nybo ..... E21B 15/02 166/79.1
4,108,318 A * 8/1978 Rode ..... E21B 19/002 212/307
4,324,077 A * 4/1982 Woolslayer ..... E21B 15/003 105/32
4,367,796 A * 1/1983 Bolding ..... E21B 19/002 166/341
4,557,332 A * 12/1985 Denison ..... E21B 17/012 166/345
4,716,972 A * 1/1988 Makinen ..... B63B 35/08 114/265
4,899,682 A * 2/1990 Pouget ..... B63B 35/4413 114/264
5,150,987 A * 9/1992 White ..... B63B 21/50 166/350
5,492,436 A * 2/1996 Suksumake ..... E02L 317/00 166/366
6,691,784 B1 * 2/2004 Wanvik ..... E21B 19/002 166/346
7,451,821 B2 * 11/2008 Rashid ..... B63B 27/02 166/351
7,628,225 B2 * 12/2009 Petersson ..... E21B 15/02 166/341
8,522,880 B2 * 9/2013 Roodenburg ..... B63B 35/4413 166/339
9,051,783 B2 * 6/2015 Croatto ..... E21B 19/002
9,238,943 B2 * 1/2016 Jordan ..... E21B 7/12
9,341,025 B2 * 5/2016 Labrugere ..... E21B 15/003
9,458,671 B2 * 10/2016 Jordan ..... E21B 7/12
9,677,368 B2 * 6/2017 Jordan ..... E21B 7/12
2002/0074125 A1 * 6/2002 Fikes ..... E21B 15/003 166/352
2003/0106695 A1 6/2003 Fikes et al.
2004/0134661 A1 * 7/2004 von der Ohe ..... E21B 19/004 166/367
2009/0025937 A1 * 1/2009 Robinson ..... E21B 15/003 166/351
2010/0147528 A1 * 6/2010 Baugh ..... E21B 19/24 166/355
2011/0100639 A1 5/2011 Roodenburg et al.
2012/0018166 A1 * 1/2012 Croatto ..... E21B 19/006 166/355
2013/0195559 A1 * 8/2013 Andresen ..... E21B 19/006 405/224.4
2016/0145943 A1 * 5/2016 Jordan ..... E21B 7/12 166/355

* cited by examiner

FIG. 4A
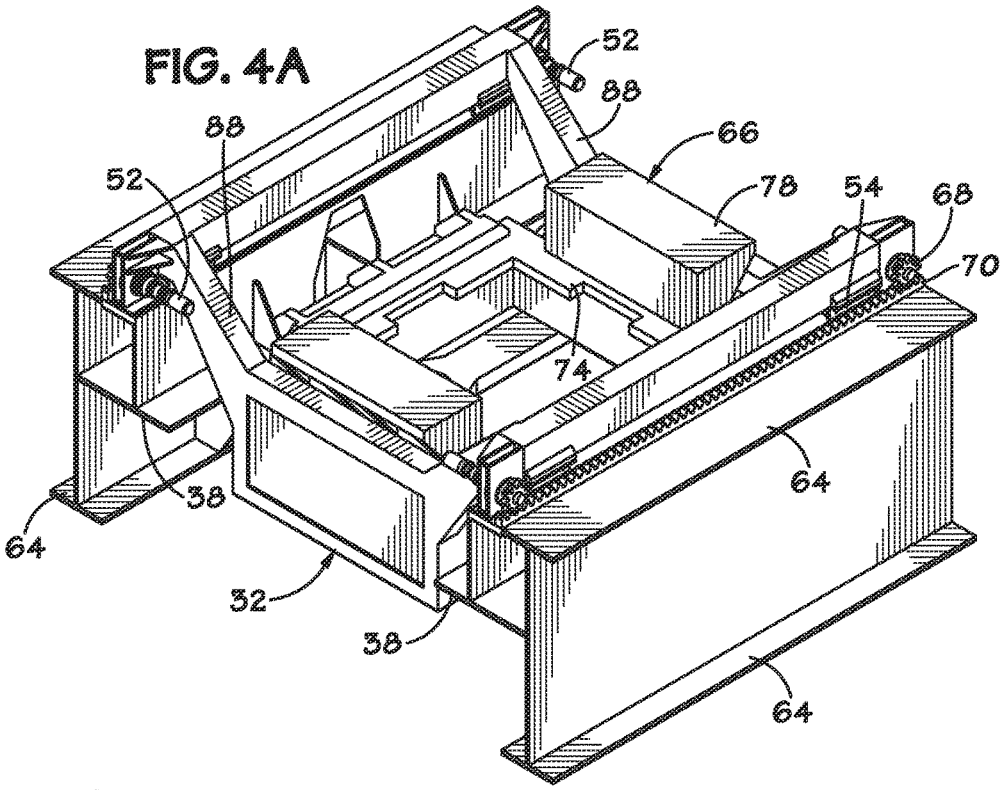
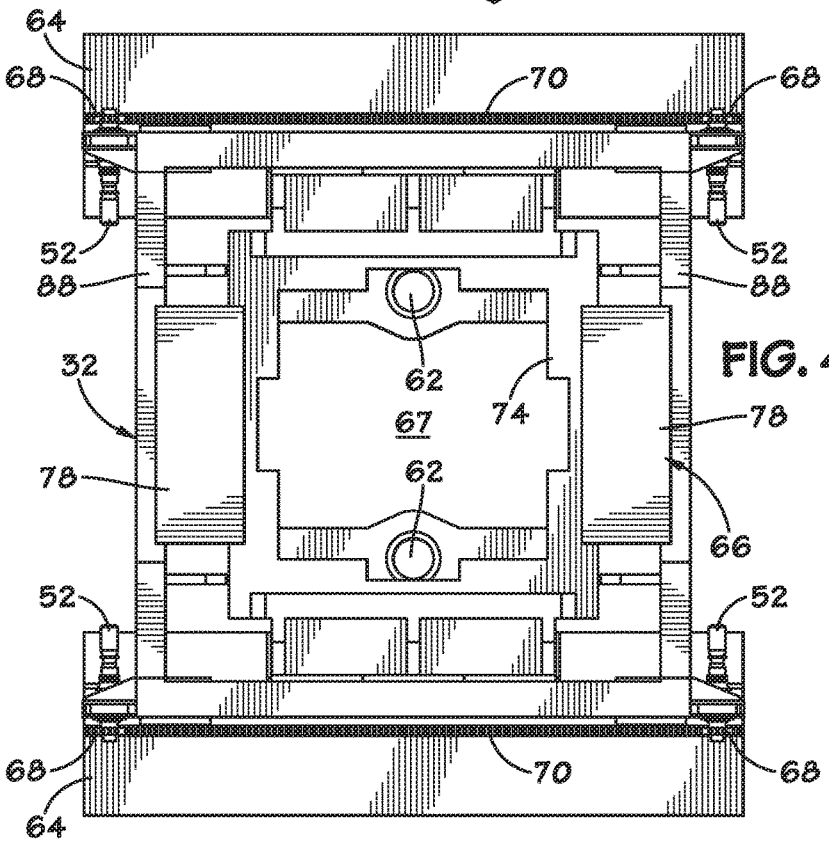
FIG. 4B

FIG. 5A
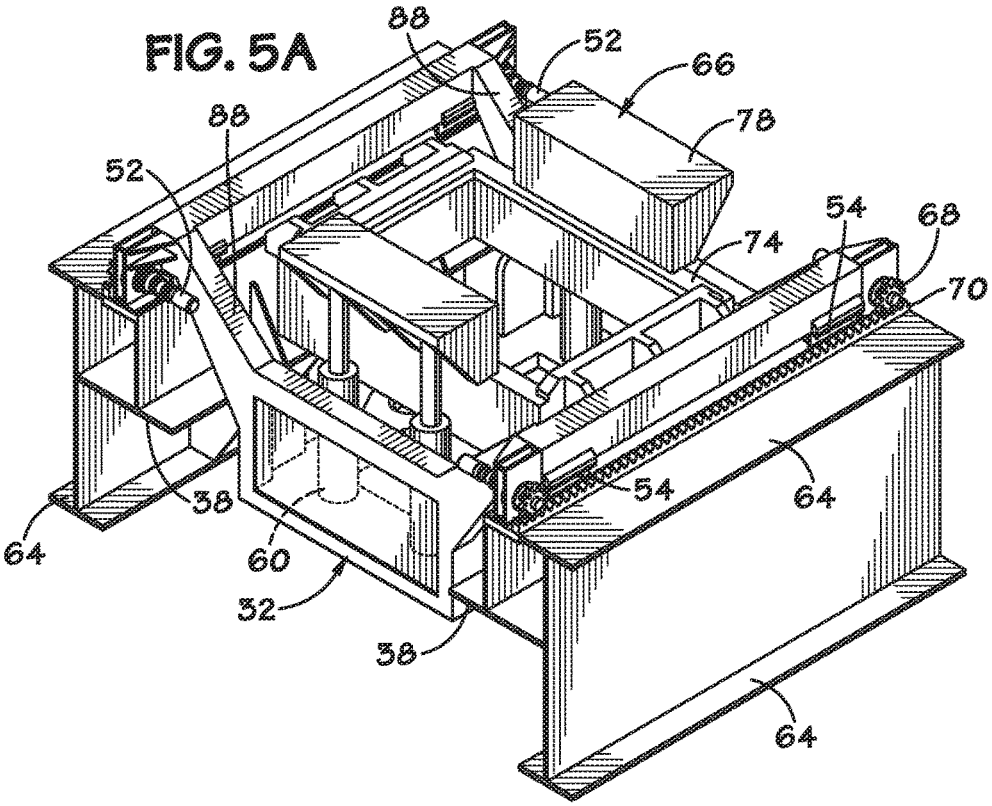
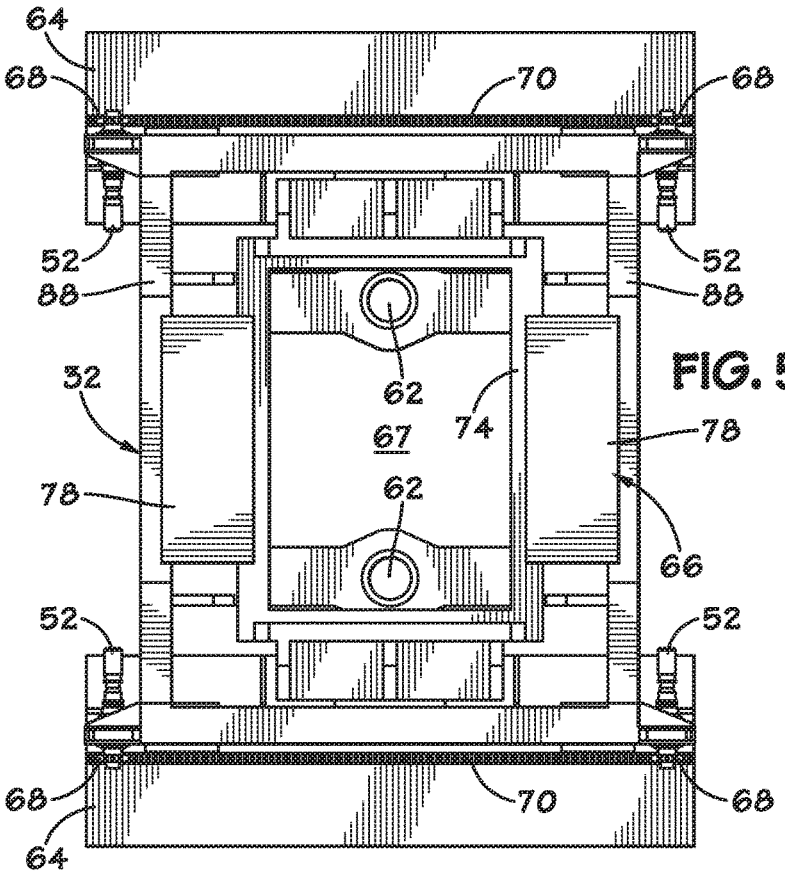
FIG. 5B

FIG. 5C
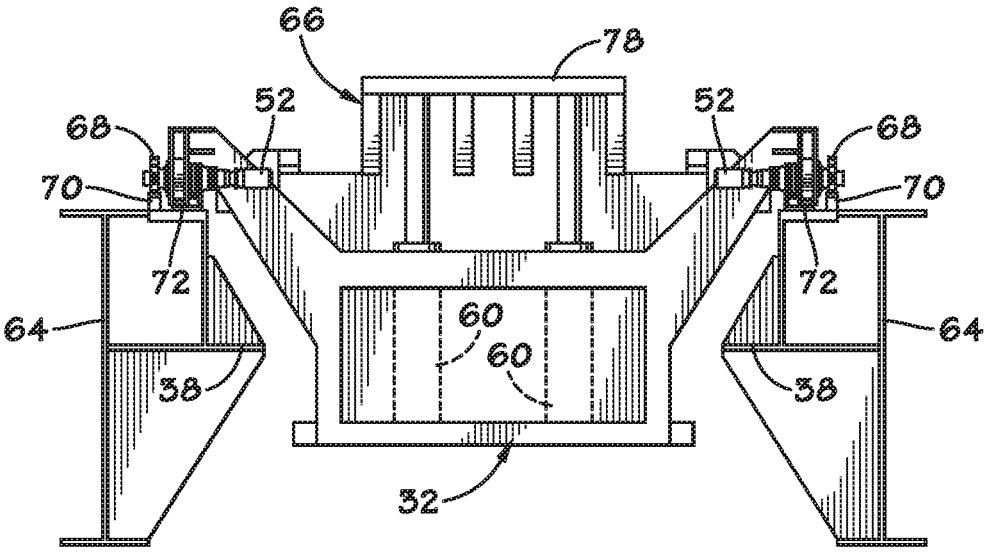
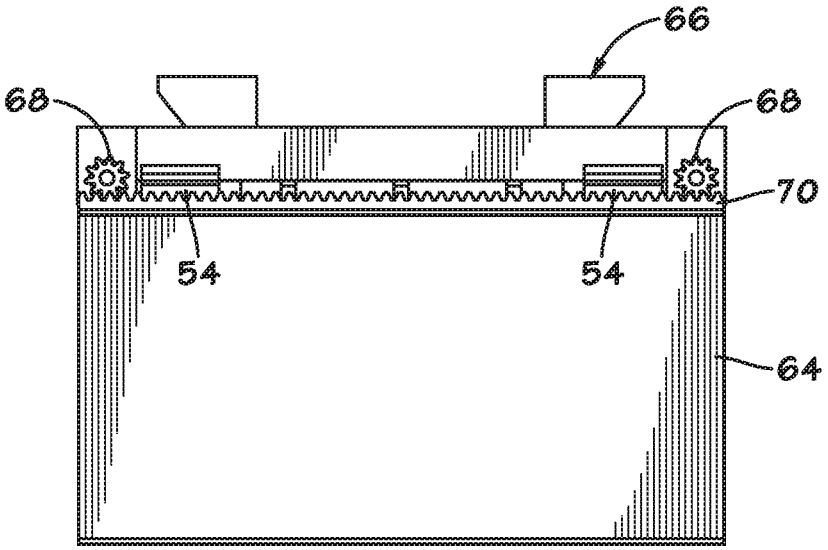
FIG. 5D

FIG. 6A
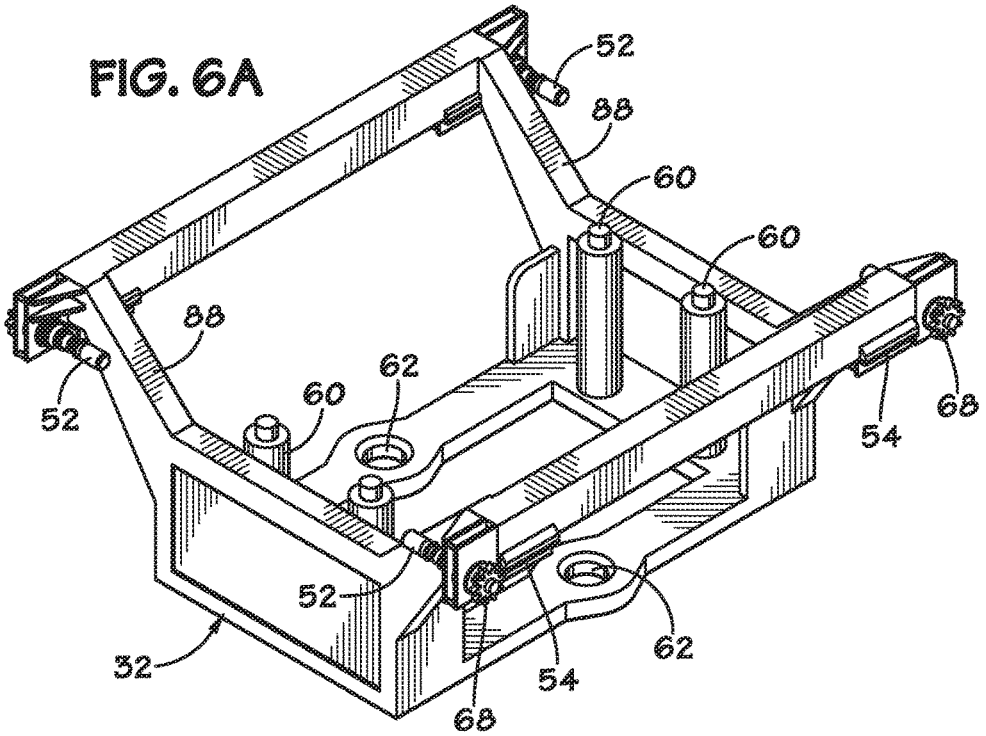
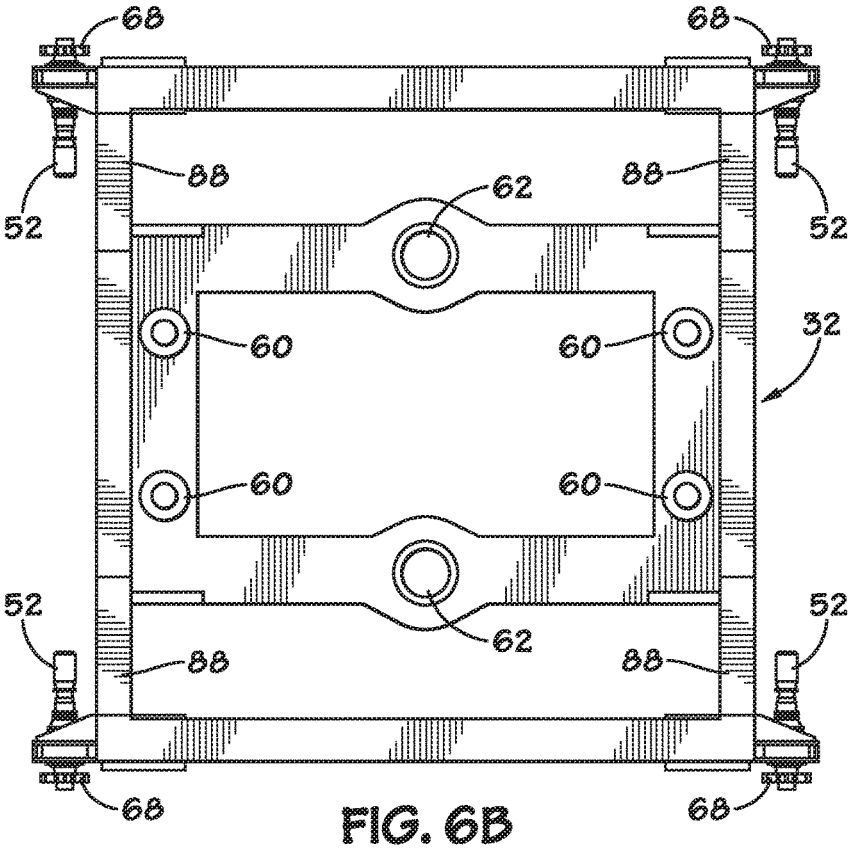
FIG. 6B

FIG. 6C
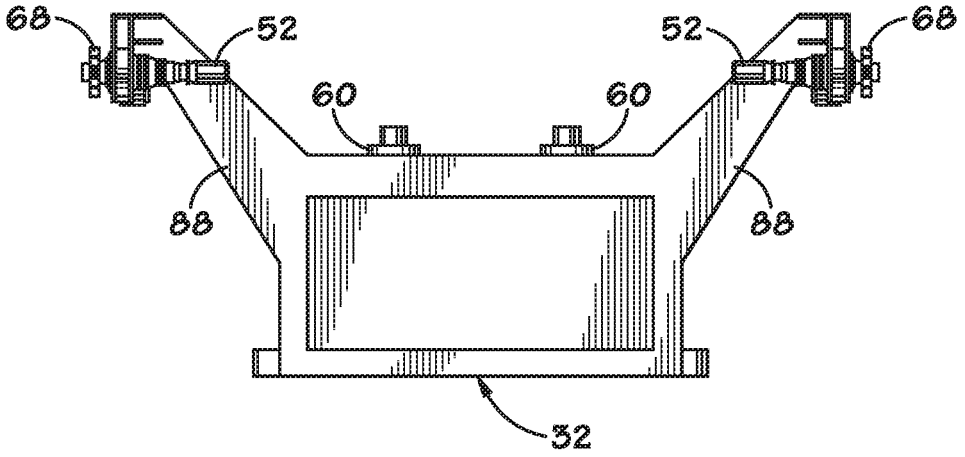
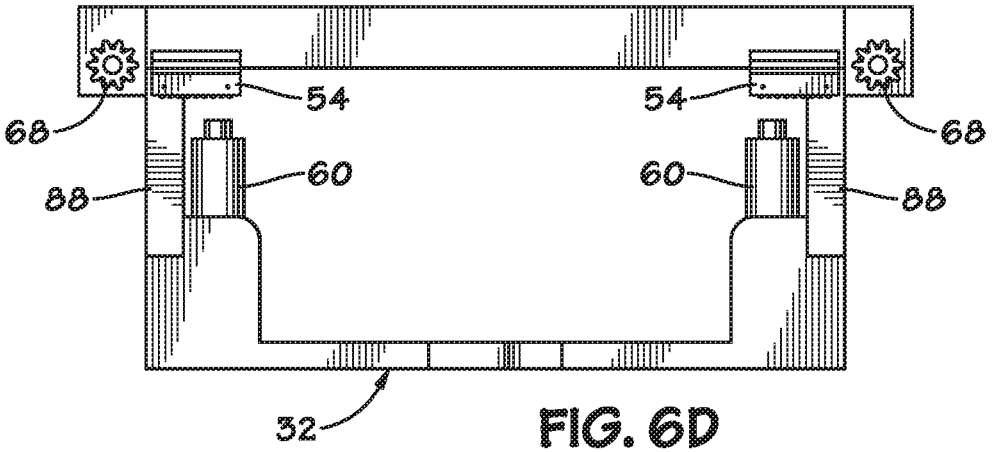
FIG. 6D

STEP 1: TIEBACK IN HOME POSITION

STEP 2: ROV REMOVES AND RECONNECTS REMOTE POST TOPS.
FOLDING ARMS ON GUIDE FRAME ARE FOLDED DOWN.

STEP 3: TIEBACK IS DISCONNECTED FROM HOME POSITION. VERTICAL CLEARANCE BETWEEN TIEBACK AND WELLHEAD IS 2FT.

STEP 4: GUIDE LINES ARE TENSIONED SO THAT TIEBACK CONNECTOR MOVES OVER ADJACENT WELL.

STEP 5: TIEBACK CONNECTOR LOWERED ONTO WELLHEAD GUIDED BY WIRE ROPES.
TIEBACK CONNECTOR IS CONNECTED TO WELLHEAD IN ADJACENT POSITION.

METHOD AND APPARATUS FOR DRILLING MULTIPLE SUBSEA WELLS FROM AN OFFSHORE PLATFORM AT A SINGLE SITE

CROSS-REFERENCE TO RELATED APPLICATIONS

This application is a continuation of U.S. application Ser. No. 15/260,900 filed Sep. 9, 2016, which is a continuation of U.S. application Ser. No. 14/919,486 filed Oct. 21, 2015, which is a continuation of U.S. application Ser. No. 13/646,277 filed on Oct. 5, 2012, which claims the benefit of U.S. Provisional Application No. 61/543,663, filed on Oct. 5, 2011, and U.S. Provisional Application No. 61/606,031, filed on Mar. 2, 2012, and U.S. Provisional Application No. 61/610,805, filed on Mar. 14, 2012. Each of these six applications is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

This invention relates to offshore drilling and production platforms. More particularly, it relates to a method and apparatus for drilling a plurality of wells at a single platform (or vessel) location and installing production risers on those wells.

2. Description of the Related Art Including Information Disclosed Under 37 CFR 1.97 and 1.98

Both tension leg platforms (TLP's) and semi-submersible floating vessels ("semis") can be used for offshore drilling and production operations.

An offshore drilling vessel (TLP) is a vertically moored floating structure typically used for the offshore production of oil and/or gas, and is particularly suited for water depths greater than about 1000 ft.

The platform is permanently moored by tethers or tendons grouped at each of the structure's corners. A group of tethers is called a tension leg. The tethers have relatively high axial stiffness (low elasticity) such that virtually all vertical motion of the platform is eliminated. This allows the platform to have the production wellheads on deck (connected directly to the subsea wells by rigid risers), instead of on the seafloor. This feature enables less expensive well completions and allows better control over the production from the oil or gas reservoir.

A semi-submersible is a particular type of floating vessel that is supported primarily on large pontoon-like structures that are submerged below the sea surface. The operating decks are elevated perhaps 100 or more feet above the pontoons on large steel columns. This design has the advantage of submerging most of the area of components in contact with the sea thereby minimizing loading from wind, waves and currents. Semi-submersibles can operate in a wide range of water depths, including deep water. The unit may stay on location using dynamic positioning (DP) and/or be anchored by means of catenary mooring lines terminating in piles or anchors in the seafloor. Semi-submersibles can be used for drilling, workover operations, and production platforms, depending on the equipment with which they are equipped. When fitted with a drilling package, they are typically called semi-submersible drilling rigs.

The DeepDraftSemi® vessel offered by SBM Offshore, Inc. (Houston, Tex.) is a semi-submersible fitted with oil and gas production facilities that is suitable for use in ultra-deep water conditions. The unit is designed to optimize vessel motions to accommodate steel catenary risers (SCRs).

BRIEF SUMMARY OF THE INVENTION

A floating, offshore drilling and/or production platform is equipped with a rail-mounted transport system that can be positioned at a plurality of selected positions over the well bay of the vessel. The transport system can move a drilling riser with a drilling riser tensioner system and a blowout preventer from one drilling location to another without removing them from the well bay of the vessel. Using the transport system, the drilling riser is lifted just clear of a first well head and positioned over an adjacent, second well head using guidelines. The transport system may then move the upper end of the drilling riser (together with its attached tensioner and BOP) to a second drilling location. A dummy wellhead may be provided on the seafloor in order to secure the lower end of the drilling riser without removing it from the sea while production risers are being installed.

BRIEF DESCRIPTION OF THE SEVERAL VIEWS OF THE DRAWING(S)

Figure 3A:
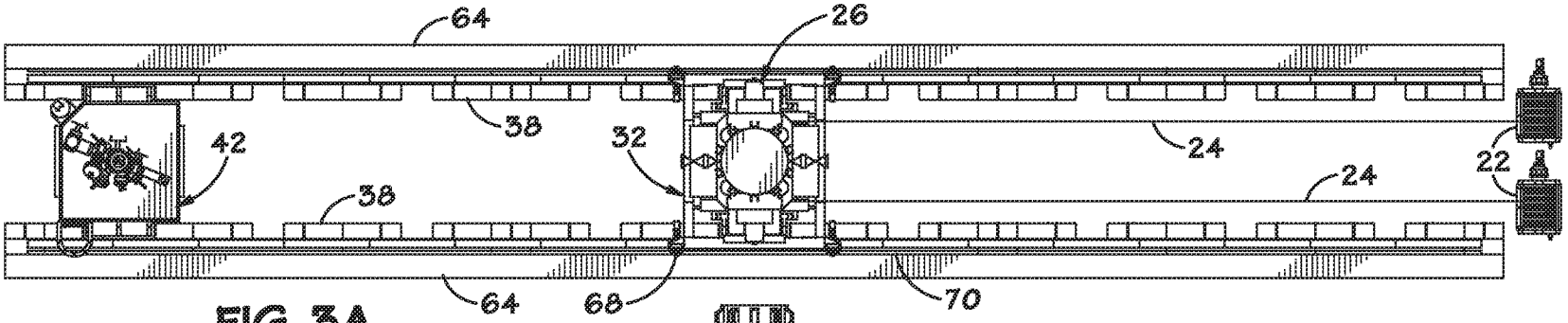
Figure 3B:
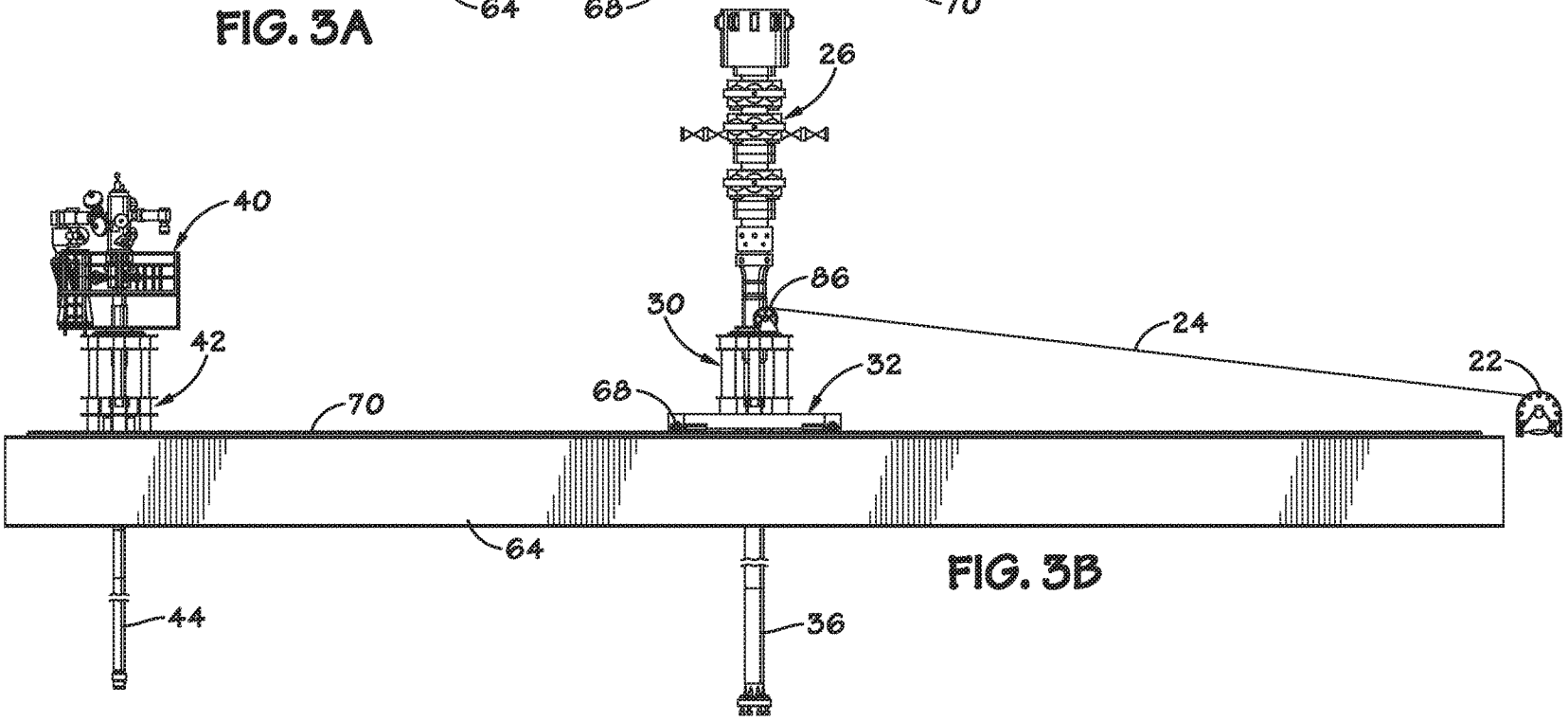
Figure 3C:
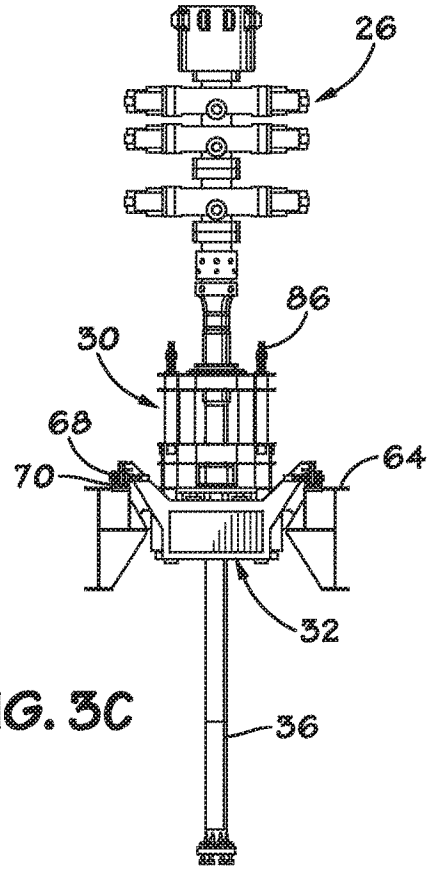

FIGS. 3A-3C show both a production riser tensioner and surface tree assembly as well as a drilling riser tension joint, drilling riser tensioner and blowout preventer assembly on a transport trolley according to the invention. FIG. 3A is a top view of the two assemblies supported on a topside deck wellbay beam according to the invention. FIG. 3B is a side view of the two assemblies supported on a topside deck wellbay beam according to the invention. FIG. 3C is an end view of the drilling riser tension joint, drilling riser tensioner and blowout preventer assembly on the transport trolley.

Figure 4C:
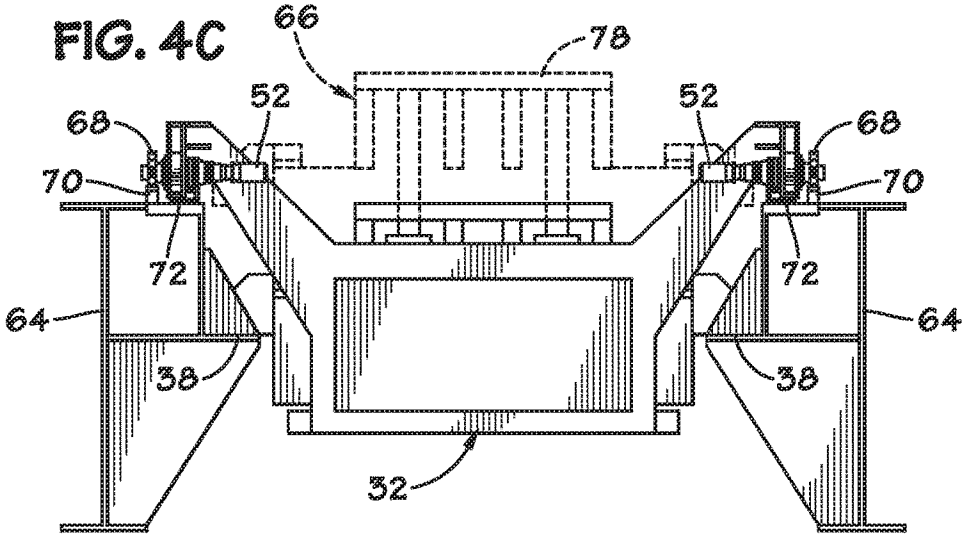
Figure 4D:
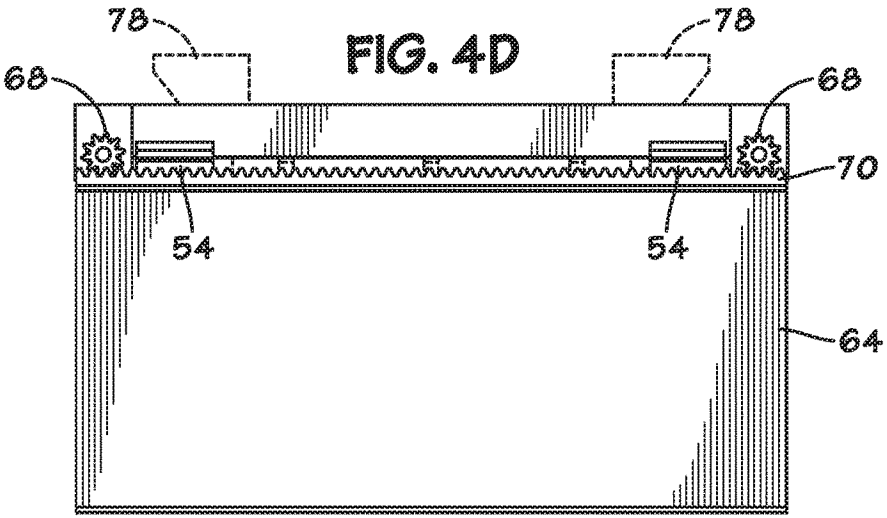

FIGS. 4A-4D show various views of an adapter frame in the retracted (drilling) position within a transport trolley according to the invention. FIG. 4A is an isometric view of the adapter frame in the retracted position. FIG. 4B is a top view of the adapter frame in the retracted position. FIG. 4C is an end view of the adapter frame in the retracted position. FIG. 4D is a side view of the adapter frame in the retracted position.

FIGS. 5A-5D show various views of an adapter frame in the extended (transfer) position within a transport trolley according to the invention. FIG. 5A is an isometric view of the adapter frame in the extended position. FIG. 5B is a top view of the adapter frame in the extended position. FIG. 5C is an end view of the adapter frame in the extended position. FIG. 5D is a side view of the adapter frame in the extended position.

FIGS. 6A-6D show various views of a transport trolley according to the invention. FIG. 6A is an isometric view of the transport trolley. FIG. 6B is a top view of the transport trolley. FIG. 6C is an end view of the transport trolley. FIG. 6D is a side view of the transport trolley.

Figure 7A:
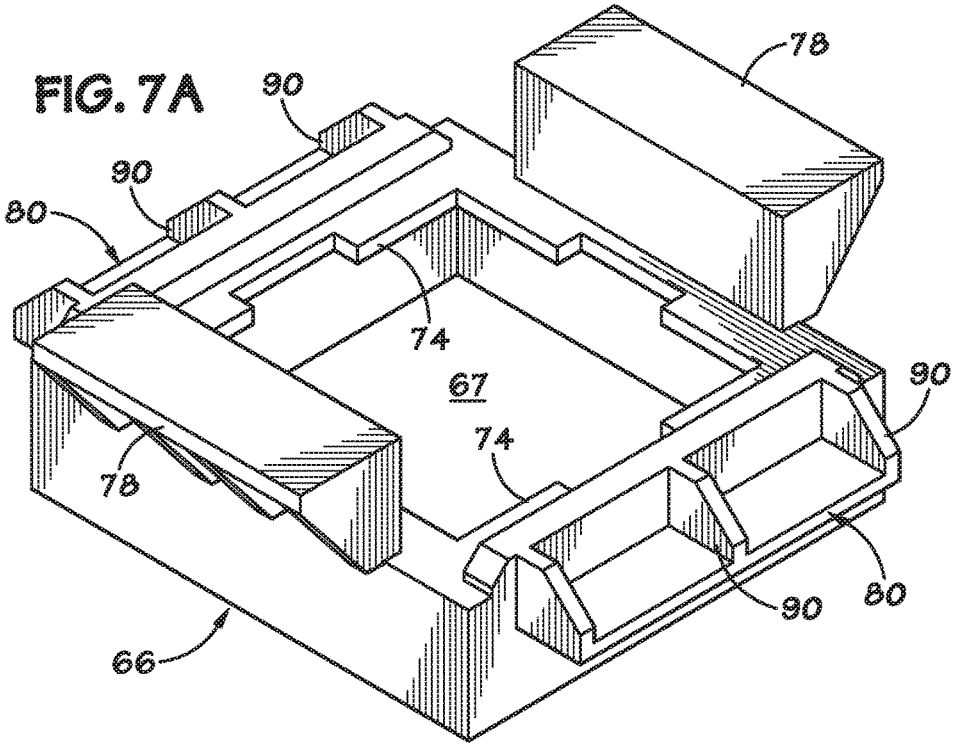
Figure 7B:
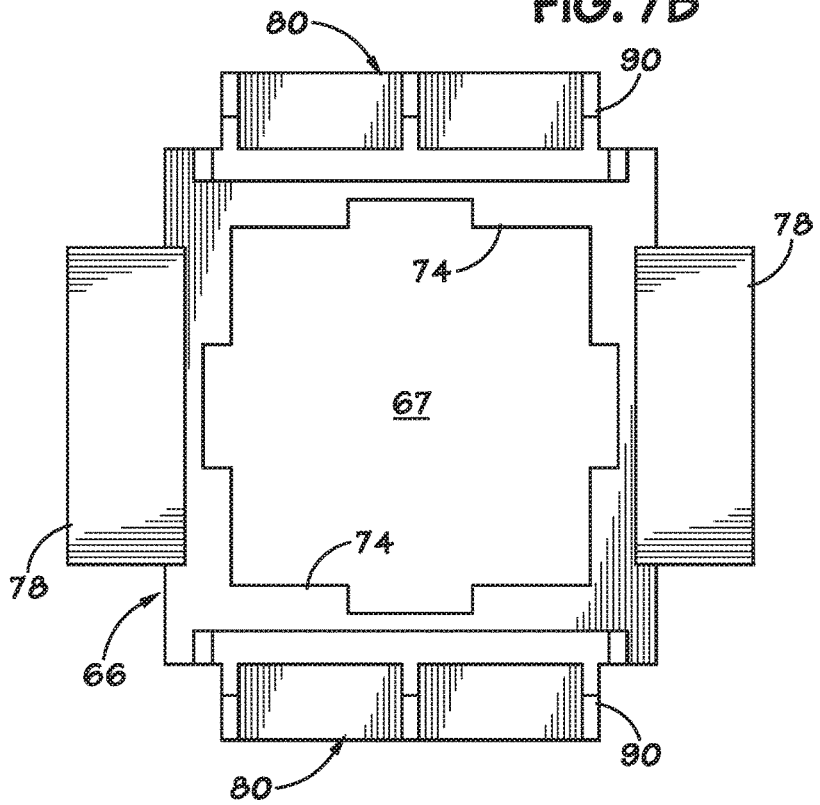
Figure 7C:
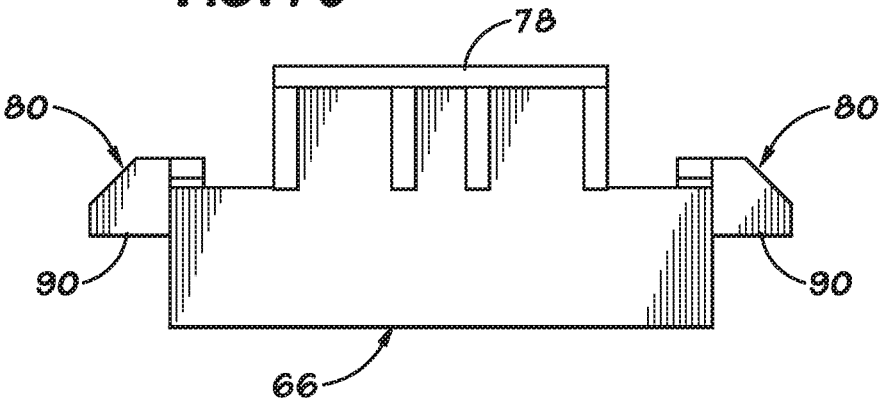
Figure 7D:
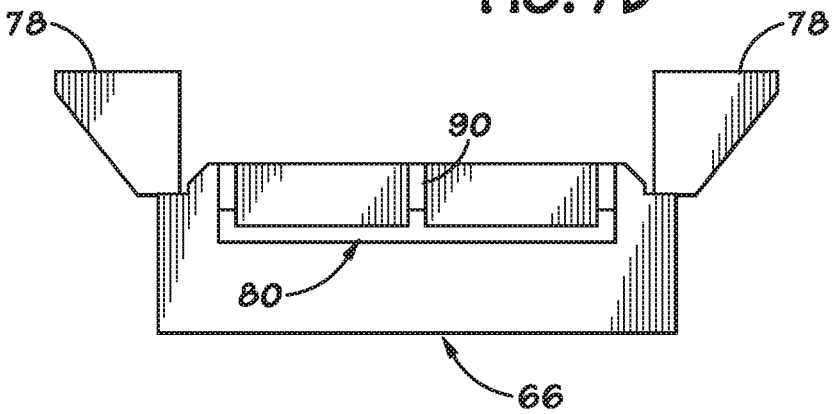

FIGS. 7A-7D show various views of an adaptor frame (or drilling riser support insert) according to the invention. FIG. 7A is an isometric view of the adaptor frame. FIG. 7B is a top view of the adaptor frame. FIG. 7C is an end view of the adaptor frame. FIG. 7D is a side view of the adaptor frame.

Figure 8A:
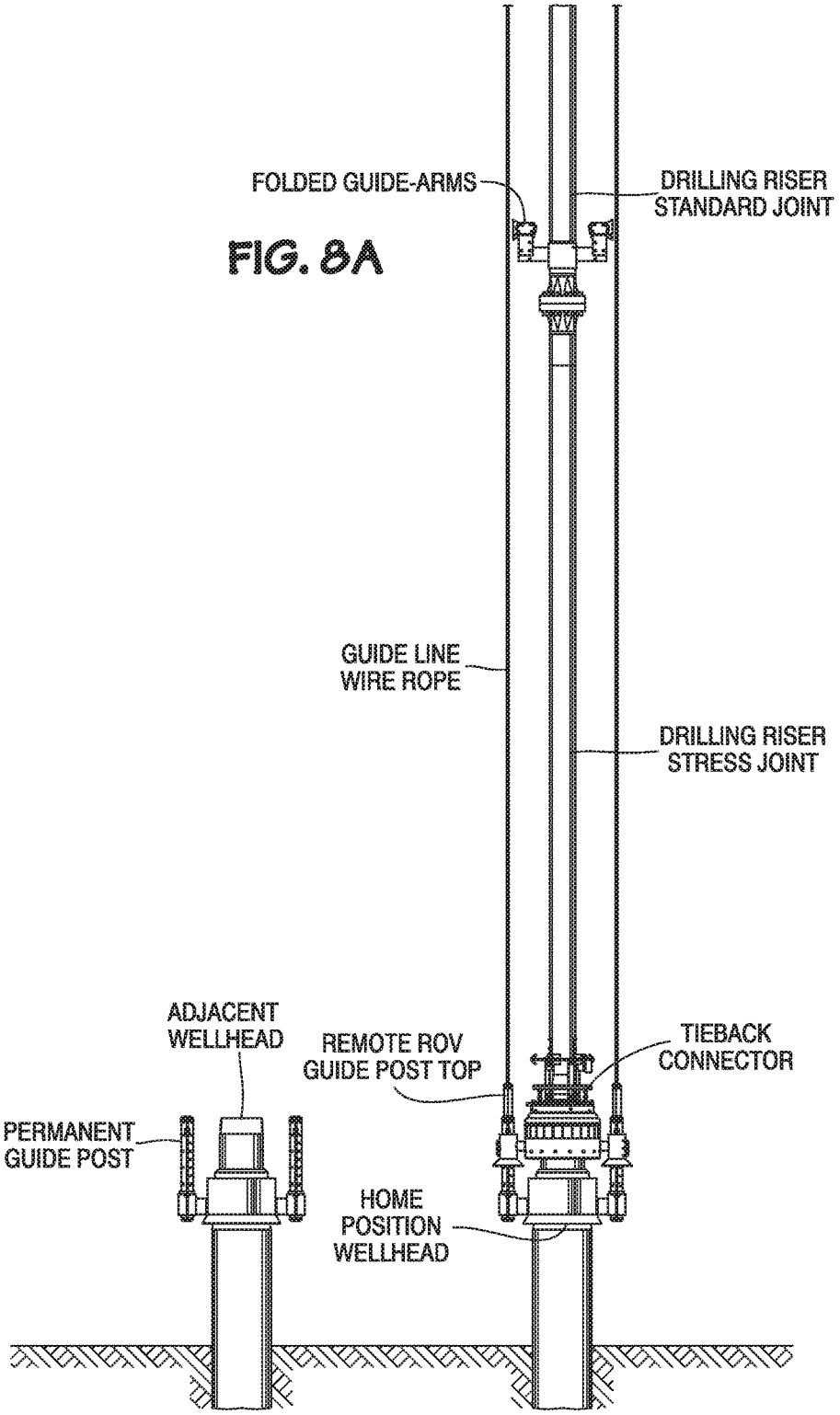
Figure 8B:
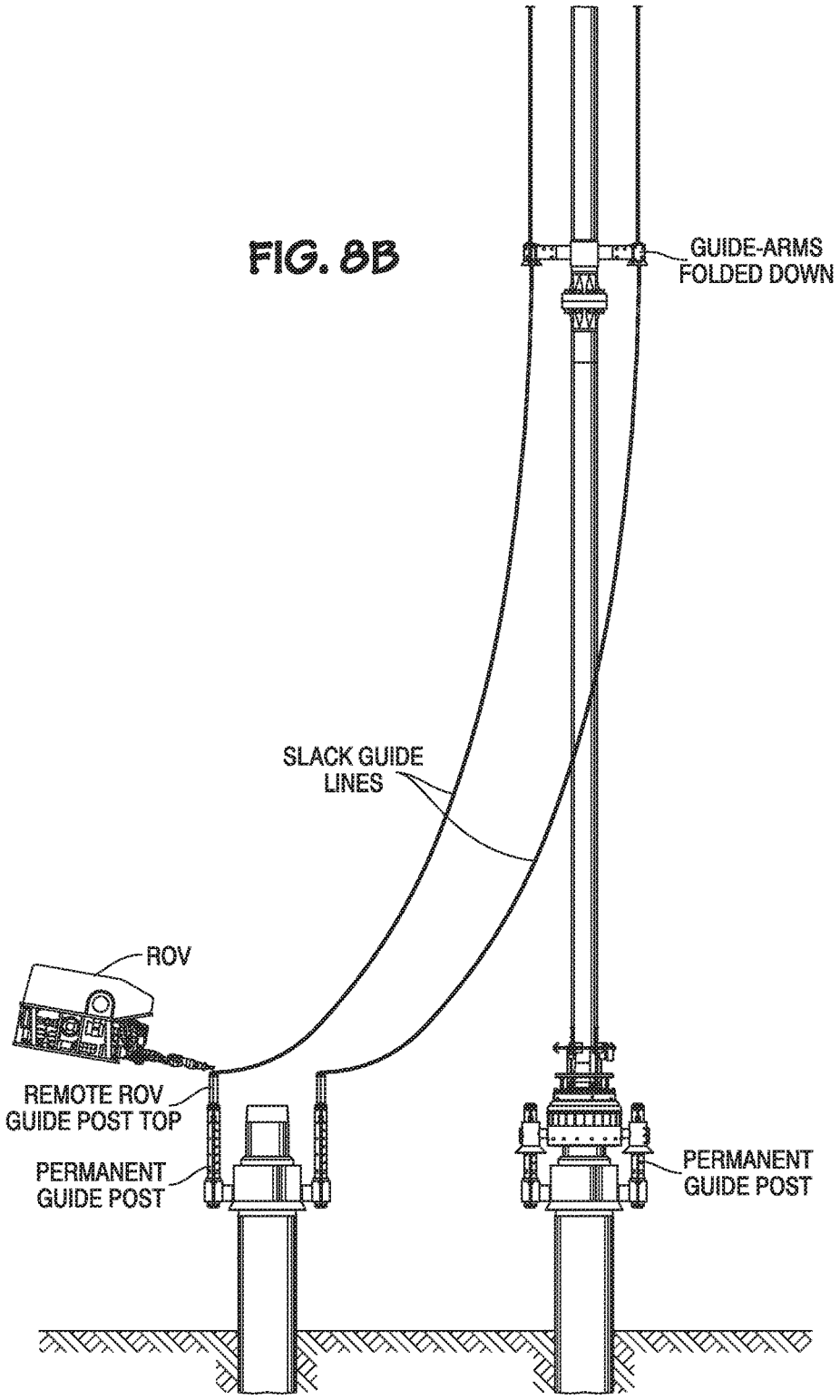
Figure 8C:
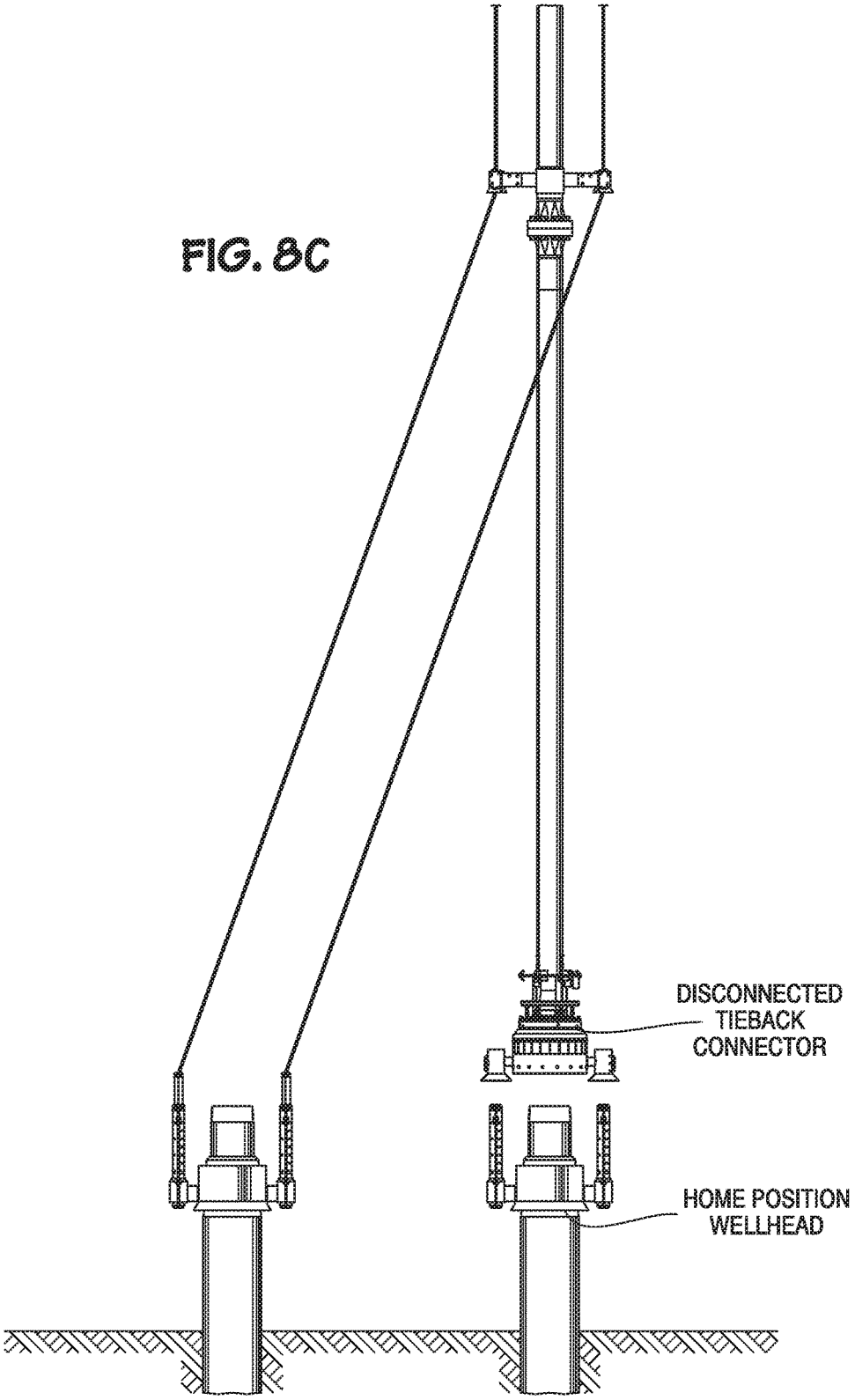
Figure 8D:
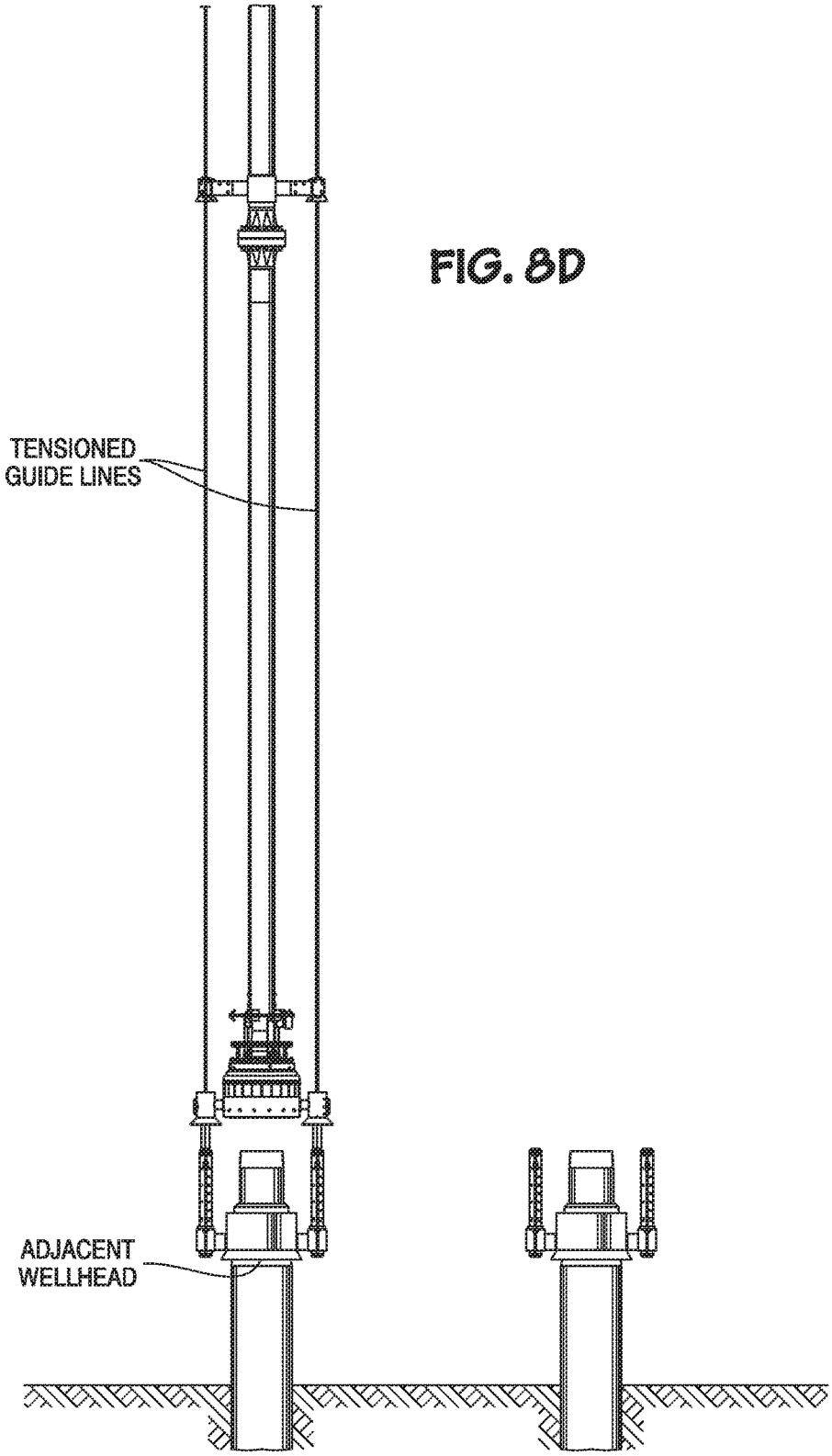
Figure 8E:
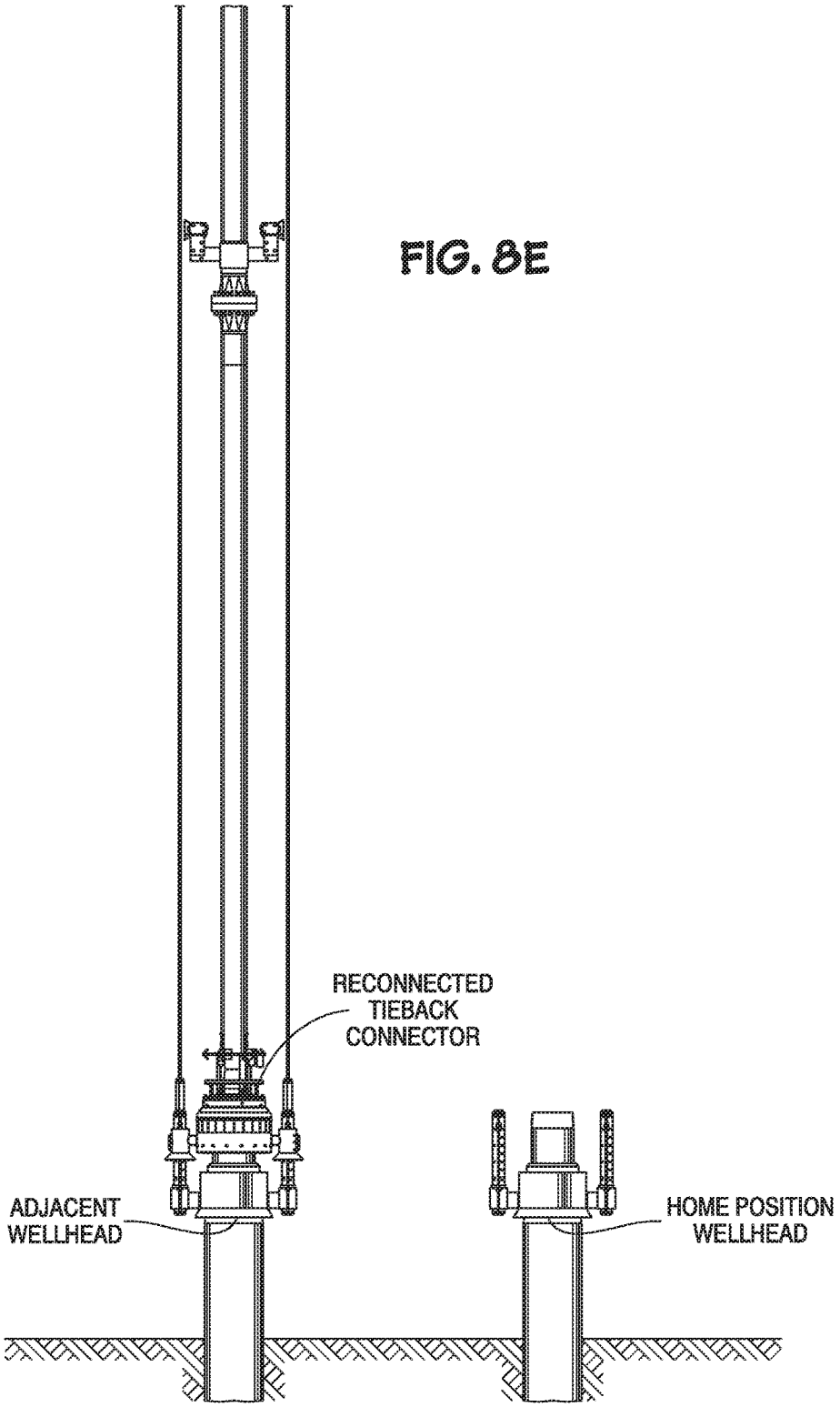

FIGS. 8A-8E illustrate the sequential steps used in transferring a drilling riser between adjacent wells on the seafloor in a method according to the invention. FIG. 8A is an illustration of Step 1 of the method. FIG. 8B is an illustration of Step 2 of the method. FIG. 8C is an illustration of Step 3 of the method. FIG. 8D is an illustration of Step 4 of the method. FIG. 8E is an illustration of Step 5 of the method.

DETAILED DESCRIPTION OF THE INVENTION

The invention may best be understood by reference to one particular preferred embodiment whose apparatus is illustrated in FIGS. 1-7 and an associated method of use is illustrated in FIG. 8 as a sequence of steps. The drawing figures outline general equipment and methodology for drilling multiple wells from a floating unit, and the installation of production risers, while minimizing or eliminating the need to retrieve the drilling riser when moving between wells.

The system shown is intended for use on a well pattern which is essentially rectangular in shape, but it should be understood that similar methodology could be adapted to well patterns of a more square shape or other patterns.

One particular feature of the system is a transfer trolley, which is suspended from the lower deck (the production deck) of the floating platform. The transfer trolley is set to run down the length of the well pattern. The position of the transfer trolley is held side to side by fixed rails, or similar, which may form part of the deck structure. The end-to-end position of the transfer trolley may be shifted using a rack-and-pinion arrangement with the pinion(s) turned by hydraulic motors or the like. The end-to-end position of the transfer trolley may be controlled by other means—for example by a pair of opposing winches used to translate the transfer trolley.

The transfer trolley may be used to transport the assembled drilling riser together with an associated tensioner and blowout preventer (BOP) between well bay positions.

Figure 1:
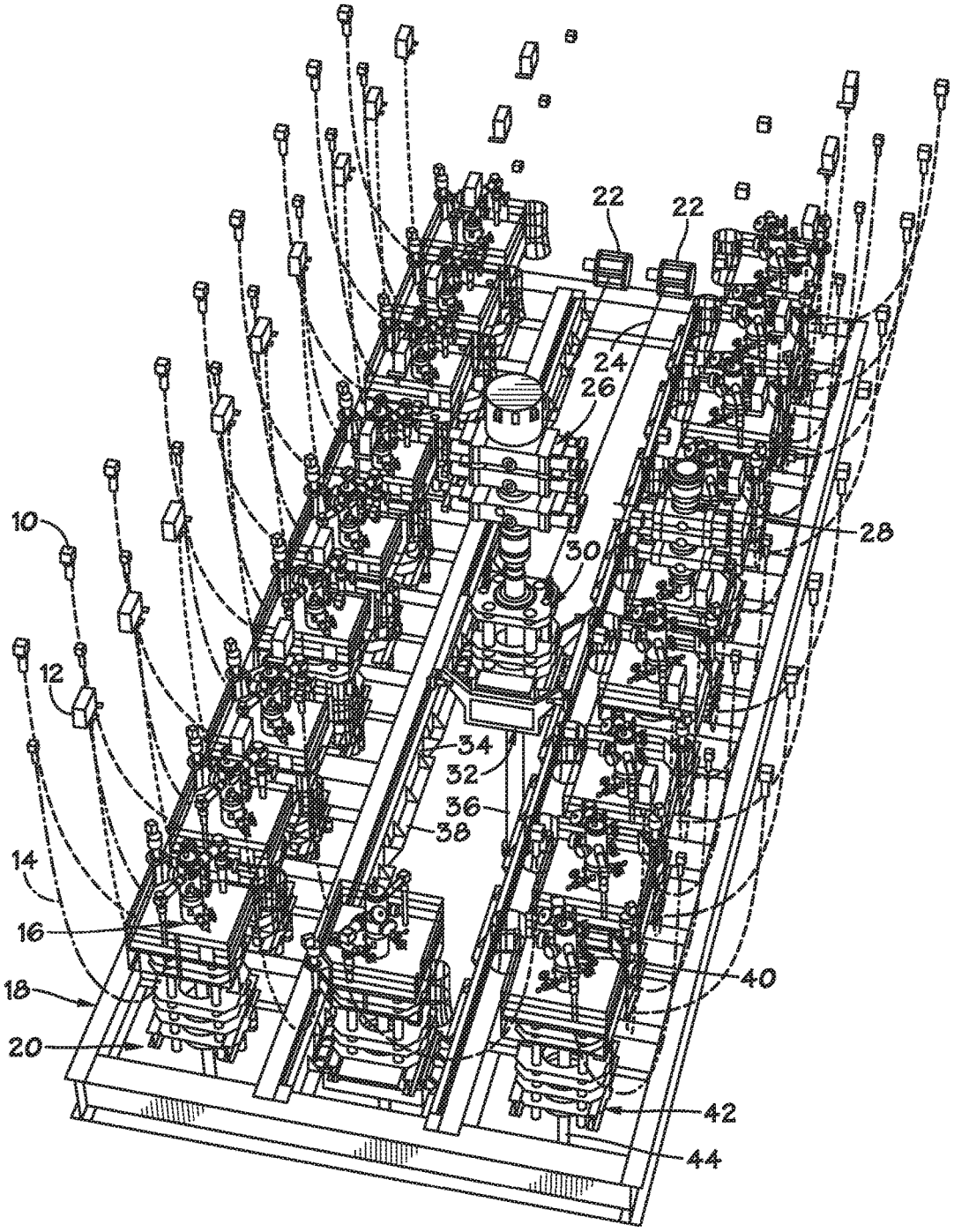
FIG. 1 is a perspective view of an isolated well bay on an offshore drilling platform according to one particular embodiment of the invention that provides for 27 production riser tensioners and up to nine locations of a moveable drilling riser tensioner and blowout preventer.

The production deck (the lower deck) of the floating structure may contain discrete (separate) tensioners 42 for the near-vertical production risers. These tensioners may be arranged in a regular geometric pattern, as shown in FIG. 1. It should be noted that the spacing of the well bay on the structure may be chosen to be consistent with the physical requirements to fit production tensioners, surface trees, connection jumpers, and other required equipment for drilling, production, work over and so forth. The wells may be spaced on the seafloor to provide access space as required for various seafloor activities related to drilling, production, etc. The seafloor and surface spacing may not necessarily be identical (due to different space requirements) but may be established in a way to minimize the offset angles between corresponding seafloor and surface locations.

Figure 2:
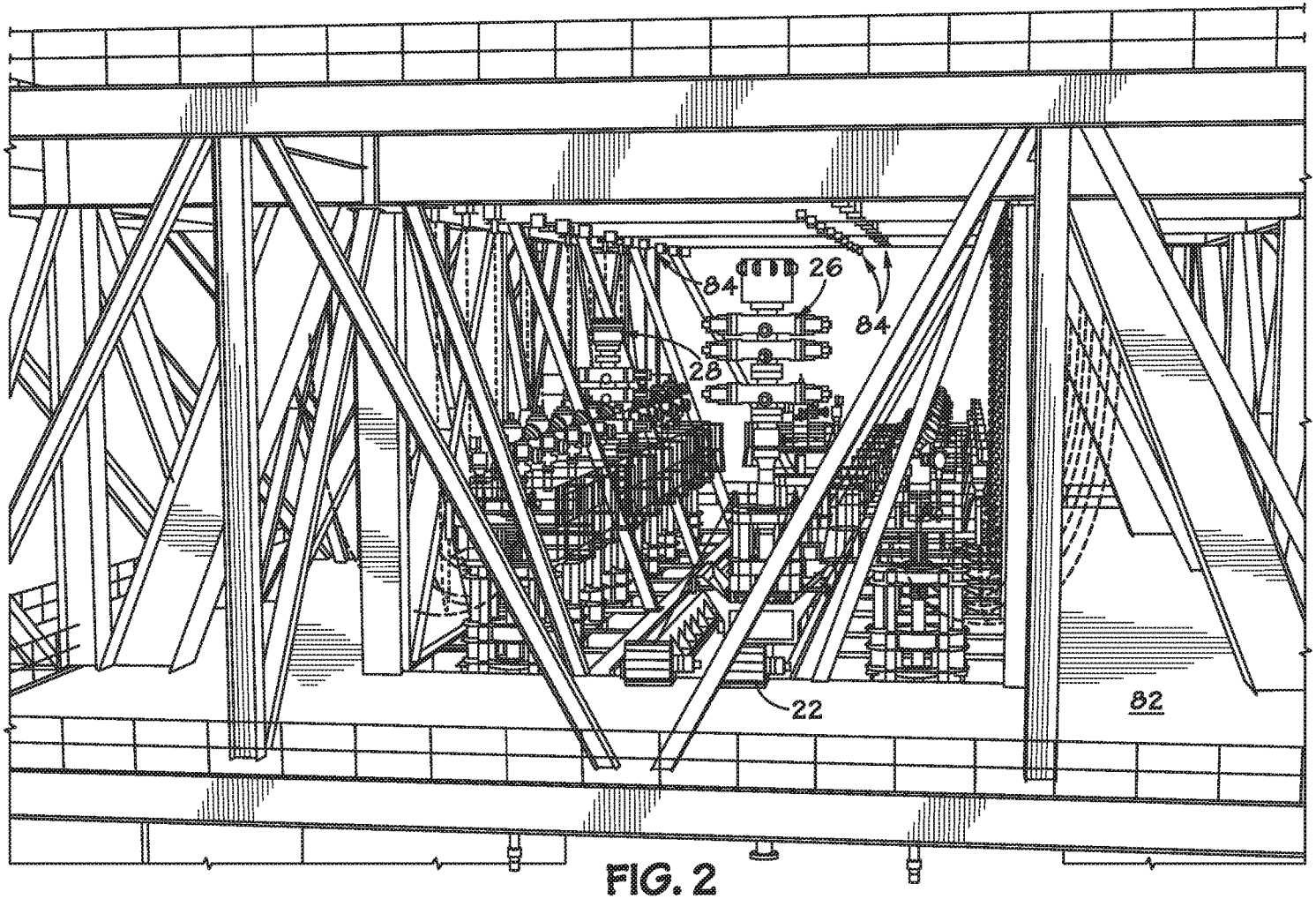
FIG. 2 shows the well bay illustrated in FIG. 1 installed in the lower deck ("production deck") of a TLP.

Referring in particular to FIGS. 1 and 2, the TLP includes provision for installation of a total of 27 riser tensioners in a 9-by-3 array of well slots 20 on the lower deck 82 of a TLP. The drilling riser is deployed only from the central of the three columns, with the ability to reach each of the 27 subsea well head locations from at least one of the nine positions within the central column. For certain well patterns, less than the full 9 central column positions may be needed to reach each of the wells on the seafloor. The central column may initially be open to allow translation of the hanging drilling riser to locations appropriate for reaching the well heads. Production risers in the two outer columns may be installed first, with tensioners 42 and surface trees 40 mounted on the lower deck (production deck) 82. As additional risers are added, inserts may be placed in the central column to allow installation of production riser tensioners therein. Tree access platforms 16 may be provided in production deck structure 18. FIG. 1 shows the outer columns with all production risers installed, a single production riser installed at one end of the central column, and the drilling riser 36 near the midpoint of the central column. FIG. 1 also shows a smaller BOP 28 (used for well completion) on a Production Riser Tensioner 42 (connected to production riser tension joint 44) in the outer row adjacent to the larger drilling BOP 26, confirming adequate clearance between the two BOP's.

FIG. 2 shows the production deck 82 of a TLP equipped with a drilling riser transport system according to the invention viewed from the opposite end of the well bay as that shown in FIG. 1 and with the topsides structure (drilling deck) in place. The two winches 22 shown at the near end of the opening in the lower deck 82 are for the drilling riser guidelines 24. This view also shows the routing of the production 10, annulus 14 and control jumpers 12 for each of the surface trees. These jumpers are routed outward on the two outer columns of wells. The boxes 84 above the central (open) column represent the tie off locations for the central wells. Note that there is ample clearance for hook up of hard piping to the drilling BOP 26.

FIG. 3B is a side view of a drilling riser assembly comprising drilling riser tension joint 36, a drilling riser tensioner system 30 and a high-pressure blowout preventer (BOP) 26 supported in a drilling riser transfer system 32 according to the invention.

As shown in FIG. 3A (a top plan view), the support inserts for both the production tensioners 42 and drilling riser tensioner 30 may rest on brackets 38 extending outward from the main beams 64 along the edges of the opening in the lower deck. The drilling riser 36 may be moved by means of a transporter 32 which fits around the Drilling Riser Transport (DRT) support insert 66 and can lift it clear of the support brackets 38.

Also shown in the top and side views of FIG. 3 are winches 22 for guide wire ropes 24. Winches 22 may be constant tension winches. Guide wire rope 24 may be routed around sheave 86 and through openings in drilling riser tensioner 30 and hole 62 (see FIG. 6A) in transport trolley 32.

As illustrated in FIG. 4, the transporter 32 may move the drilling riser assembly (26+30+36 in FIG. 3) on rails 34 (FIG. 1) by means of a rack-and-pinion drive system, located on the edges of the opening in the lower deck. Racks 70 may be attached to well bay support beams 64 and/or tracks 72 and pinions 68 may be mounted on transport trolley 32 and connected to hydraulic drive motors 52. The transporter may be supported by HILMAN ROLLERS® roller mechanisms 54 (Hilman Inc., Marlboro, N.J. 07746) resting on horizontal tracks 72. As shown in FIG. 4, the drive system of the illustrated embodiment uses four drive motors. In addition, the motion of the transporter may be controlled by guide rollers (not shown) reacting on the sides of the track on one or both sides of the opening in the lower deck.

In FIG. 4, adaptor frame 66 is shown in the retracted position. The extended position of the adaptor frame 66 is shown in phantom in FIG. 4C and FIG. 4D. When in the retracted position, the adaptor frame 66 is supported by deck support brackets 38 and not (to any significant degree) by transport trolley 32. It will be appreciated that the retracted position of adaptor frame 66 is that used during drilling operations. When in the retracted position, the reactive force of the drilling riser tensioner system 30 is transmitted to the deck structure 64 via deck support brackets 38. The supports of transport trolley 32 (e.g., Hilman rollers 54 and support arms 88) are not exposed to the dynamic loads of heave compensation imposed by tensioner system 30.

FIG. 5 is similar to FIG. 4, but with adaptor frame 66 in the extended position. As shown in FIG. 5, the DRT support insert 66 may be lifted relative to the transporter 32 by four hydraulic cylinders 60, two on each side of the insert. The geometric shape of the support insert and the transporter may be such that overlap between the two parts provides guidance as the support insert rises, limiting lateral loads on the hydraulic cylinders.

Extending adapter frame 66 results in lifting the drilling riser assembly sufficiently to clear the wellhead on the seafloor to which is was connected. This permits the drilling riser assembly to be moved horizontally within the well bay without disconnecting either the drilling BOP 26 or the drilling riser tensioner system 30. Moreover, the drilling riser itself may remain in the sea. In certain embodiments, a dummy wellhead may be provided on the seafloor for landing and securing the lower end of the drilling riser while production risers are run. This can help to prevent collisions between the risers.

FIG. 6 contains four views of a transport trolley 32 according to one embodiment of the invention—FIG. 6A is an isometric view, FIG. 6B is a top plan view, FIG. 6D is a side view and FIG. 6C is an end view. Adapter frame lift cylinders 60 are shown within transport trolley 32. Also shown are openings 62 for guidelines 24 which may be sized to also permit passage of the remote ROV guide post tops (see FIG. 8).

FIG. 7 contains four views of an adapter frame 66 according to one embodiment of the invention—FIG. 7A is an isometric view, FIG. 7B is a top plan view, FIG. 7D is a side view and FIG. 7C is an end view. Adapter frame 66 has a central opening 67 with a perimeter rim 74 which may project into opening 67. Rim (or flange) 74 may be sized and configured to fit drilling riser tensioner system 30. Drilling riser tensioner system 30 is supported on rim 74. Load brackets 80 are sized and configured to engage deck support brackets 38. Lift extensions 78 are sized and configured to engage adapter frame lift cylinders 60. In a system according to the invention, the static load of the drilling riser assembly is borne on lift extensions 78 when transport trolley 32 is moved horizontally but the static and dynamic loads are borne by load extensions 80 when the drilling riser is connected and tensioned by tensioner system 30. As shown in FIG. 7, load extensions 80 may be reinforced with gussets 90.

Specific design parameters for one particular preferred embodiment of a drilling riser transport system according to the invention are:

- The transporter 32 may be supported by four sets of Hillman rollers 54.
- The top of the DRT support insert 66 is level with the top of the support rails when the transporter lift cylinders 60 are retracted.
- The DRT 30 fits within the inner opening 67 of the support insert 66, and is supported by a ledge 74 around the perimeter of the opening.
- Lift of the DRT support insert 66 relative to the transporter 32 is sufficient to clear the well head and its associated guide posts.
- Maximum load carried by the DRT support insert 66 is carried through the brackets 80.
- Static load only is carried by the transporter 32 during lift and movement of the drilling riser.
- The transporter 32 carries no load when the DRT support insert 66 is resting on the brackets 80.
- The transporter may be driven by a rack 70 and pinion 68 system powered by hydraulic drive motors 52.

As shown in the sequence illustrated in FIG. 8, the transfer method according to the invention begins at Step 1 (FIG. 8A) with the drilling riser and its associated tieback connector attached to a home position wellhead. At Step 2 (FIG. 8B), the guidelines are slackened so that the ROV can unlock the upper section of the guideposts ("guide post tops") and move them to the adjacent wellhead. If not already deployed, the guide arms may be folded down (using the ROV) and the guidelines reattached to the drilling riser by positioning the guidelines in the lower guide arms via gates in the guide arms. In Step 3 (FIG. 8C), the tieback is disconnected from the home position wellhead and lifted by extending the adapter frame lift cylinders 60. This provides sufficient clearance to move the tieback connector from the home position wellhead to the adjacent wellhead by applying a selected amount of tension to the guidelines 24 using guide line winches 22 (which may be constant tension winches). The transporter 32 may concurrently move the drilling riser to the closest available drilling position over the target wellhead. The lower guide arms may be free to swivel around the tie back connector to align and connect with the guidelines and guideposts. The guide arms may be sized such that, in the folded position, they may pass through passageways in the drilling riser tensioner and opening 67 in drilling riser transfer trolley 32. After full positioning tension is applied to the guidelines thereby realigning the tieback connector over the adjacent well (Step 4; FIG. 8D), the drilling riser may be lowered (Step 5; FIG. 8E) by retracting hydraulic lift cylinders 60, and the tie back connector landed and locked on the adjacent wellhead.

Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A method of moving a subsea drilling riser within a well bay of an offshore drilling vessel comprising:

- providing a blowout preventer (BOP) on an upper end of the drilling riser;
- providing a drilling riser tensioner proximate the upper end of the drilling riser;
- suspending the drilling riser together with the BOP and the drilling riser tensioner in a transport trolley configured for translational movement within the well bay of the offshore drilling vessel;
- moving the suspended drilling riser together with the BOP and the drilling riser tensioner in the transport trolley from a first drilling location in the well bay to a second drilling location in the well bay without removing the drilling riser from the well bay.

2. The method recited in claim 1 wherein the offshore drilling vessel is a tension leg platform (TLP).

3. The method recited in claim 1 wherein the offshore drilling vessel is a semi-submersible vessel.

4. The method recited in claim 1 wherein moving the suspended drilling riser together with the BOP and the drilling riser tensioner in the transport trolley from the first drilling location in the well bay to the second drilling location in the well bay is performed without removing the BOP from the drilling riser.

5. The method recited in claim 1 wherein moving the suspended drilling riser together with the BOP and the drilling riser tensioner in the transport trolley from the first drilling location in the well bay to the second drilling location in the well bay is performed without removing the drilling riser tensioner from the drilling riser.

6. The method recited in claim 1 wherein the transport trolley configured for translational movement within the well bay of the offshore drilling vessel is configured to move on rails.

7. The method recited in claim 1 wherein the transport trolley configured for translational movement within the well bay of the offshore drilling vessel is configured to move on rollers resting on horizontal tracks.

8. The method recited in claim 1 further comprising:

elevating the drilling riser in the transport trolley by an amount sufficient to provide a clearance between a lower end of the riser and a wellhead on the seafloor prior to moving the suspended drilling riser together with the BOP and the drilling riser tensioner in the transport trolley from the first drilling location in the well bay to the second drilling location in the well bay without removing the drilling riser from the well bay.

9. The method recited in claim 1 further comprising:

providing a riser tension joint at the upper end of the drilling riser.

10. The method recited in claim 1 further comprising:

providing a dummy wellhead on the seafloor; and securing a lower end of the drilling riser to the dummy wellhead on the seafloor.

11. A method of moving a subsea drilling riser within a well bay of an offshore drilling vessel comprising:

providing a drilling riser tensioner proximate an upper end of the drilling riser;

suspending the drilling riser together with the drilling riser tensioner in a transport trolley configured for translational movement within the well bay of the offshore drilling vessel;

moving the suspended drilling riser together with the drilling riser tensioner in the transport trolley from a first drilling location in the well bay to a second drilling location in the well bay without removing the drilling riser from the well bay.

12. The method recited in claim 11 wherein the offshore drilling vessel is a tension leg platform (TLP).

13. The method recited in claim 11 wherein the offshore drilling vessel is a semi-submersible vessel.

14. The method recited in claim 11 wherein moving the suspended drilling riser together with the drilling riser tensioner in the transport trolley from the first drilling location in the well bay to the second drilling location in the well bay is performed without removing the drilling riser tensioner from the drilling riser.

15. The method recited in claim 11 further comprising:

elevating the drilling riser in the transport trolley by an amount sufficient to provide a clearance between a lower end of the riser and a wellhead on the seafloor prior to moving the suspended drilling riser together with a BOP attached thereto and the drilling riser tensioner in the transport trolley from the first drilling location in the well bay to the second drilling location in the well bay without removing the drilling riser from the well bay.

16. The method recited in claim 11 further comprising:

providing a riser tension joint at the upper end of the drilling riser.

17. The method recited in claim 11 further comprising:

providing a dummy wellhead on the seafloor; and securing a lower end of the drilling riser to the dummy wellhead on the seafloor.

18. A method of moving a subsea drilling riser within a well bay of an offshore drilling vessel comprising:

providing a blowout preventer (BOP) on an upper end of the drilling riser;

providing a drilling riser tensioner proximate the upper end of the drilling riser;

suspending the drilling riser together with the BOP and the drilling riser tensioner in a transport trolley configured for translational movement within the well bay of the offshore drilling vessel;

providing at least one pair of guidelines extending from the transport trolley to a first wellhead on the seafloor;

providing a tieback connector on a lower end of the drilling riser, said tieback connector configured for attaching the lower end of the drilling riser to a subsea wellhead;

slackening the at least one pair of guidelines extending from the transport trolley to the first wellhead on the seafloor;

detaching the at least one pair of guidelines from the first wellhead on the seafloor;

moving the slackened pair of guidelines to an adjacent second wellhead on the seafloor;

releasing the tieback connector from the first wellhead;

elevating the drilling riser in the transport trolley by an amount sufficient to provide a clearance between the lower end of the riser and the first wellhead on the seafloor;

applying a selected amount of tension to the at least one pair of guidelines so as to align the lower end of the drilling riser with the second wellhead on the seafloor;

moving the suspended drilling riser together with the BOP and the drilling riser tensioner in the transport trolley from a first drilling location in the well bay to a second drilling location in the well bay without removing the drilling riser from the well bay;

lowering the drilling riser in the transport trolley by an amount sufficient to land the tieback connector on the second wellhead; and locking the tieback connector to the second wellhead.

19. The method recited in claim 18 wherein detaching the at least one pair of guidelines from the first wellhead on the seafloor and moving the slackened pair of guidelines to the adjacent second wellhead on the seafloor are performed by a subsea remotely operated vehicle (ROV).

20. The method recited in claim 18 wherein releasing the tieback connector from the first wellhead and locking the tieback connector to the second wellhead are performed by a subsea remotely operated vehicle (ROV).

* * * * *